US005454502A

United States Patent [19]

Hashikawa

[11] Patent Number: 5,454,502

[45] Date of Patent: Oct. 3, 1995

[54] CIRCULAR TYPE TENSION APPLYING APPARATUS FOR SLIT BAND PLATES

[75] Inventor: Yoshito Hashikawa, Nagasaki, Japan

[73] Assignee: Japan Development Consultants, Inc., Nagasaki, Japan

[21] Appl. No.: 264,377

[22] Filed: Jun. 23, 1994

[30] Foreign Application Priority Data

Nov. 5, 1993 [JP] Japan ..... 5-300989
May 6, 1994 [JP] Japan ..... 6-117538

[51] Int. Cl.[6] ..... B65H 23/10

[52] U.S. Cl. ..... 226/195; 242/419.5

[58] Field of Search ..... 242/419.5, 530.1, 242/530.2, 530.3, 530.4, 151, 152; 226/195

[56] References Cited

U.S. PATENT DOCUMENTS

| | | | |
|---|---|---|---|
| 3,386,679 | 6/1968 | Foulon et al. | 242/419.5 |
| 3,735,937 | 5/1973 | Plantard | 242/419.5 |
| 5,069,427 | 12/1991 | Umlauf | 266/104 |
| 5,265,817 | 11/1993 | Gaudin | 242/419.5 |

FOREIGN PATENT DOCUMENTS

| | | | |
|---|---|---|---|
| 195096 | 9/1986 | European Pat. Off. | 242/419.5 |
| 0427580 | 5/1991 | European Pat. Off. . | |
| 2404360 | 9/1974 | Germany | 242/419.5 |
| 252844 | 2/1990 | Japan | 242/419.5 |
| 1342907 | 1/1974 | United Kingdom . | |

*Primary Examiner*—John M. Jillions
*Attorney, Agent, or Firm*—Sughrue, Mion, Zinn, Macpeak & Seas

[57] ABSTRACT

A circular type tension applying apparatus for slit band plates comprises a plurality of pairs of upper and lower endless belts for interposing the respective slit band plate, an upper pressure applying member for allowing the upper endless belts to rotate and for applying pressure to the upper endless belts, and a lower pressure applying member for allowing the lower endless belts to rotate and for applying pressure to the lower endless belts. Each of the endless belts is able to rotate independently and circularly, and an outer surface of the endless belts being larger in friction than an inner surface of the endless belts. Both of the upper and lower pressure applying members are substantially circular in section. Furthermore, the endless belts have sufficient compressibility and restoration force in thickness direction so that tension is generated by resistance force from a deformation by compressive strain of the endless belts.

9 Claims, 3 Drawing Sheets

CIRCULAR TYPE TENSION APPLYING APPARATUS FOR SLIT BAND PLATES

BACKGROUND OF THE INVENTION

The present invention relates to a circular type tension applying apparatus for uniformly applying tension to slit band plates. More particularly, the invention relates to a circular type tension applying apparatus for correcting an uneven tension in the slit band plates, after a process of slitting a wide, metal band plate into a number of band plates in a slitter line, the uneven tension which is caused in the wind-up process.

Generally, a wide band plate, when viewed in cross section, is not perfectly flat in shape. It is thick in the middle and thin at both ends. When the wide band plate is slit into band plates, slit band plates that were located in the middle are different in thickness from those that were located at both ends. When the slit band plates are wound up on a mandrel, the thick slit band plates wound around the mandrel are larger in diameter the thin slit band plates, a speed of winding up the slit band plates in the middle of the mandrel is different from the wind-up speed at both ends, and the slit band plates to be wound up are tensed nonuniformly. The slit band plates are more loosely wound up on the end parts of the mandrel than those wound up on the mid parts. Those slit band plates, when wound off the mandrel, are deformed telescopically or elliptically. The deformation of the slit band plates makes impossible the unwinding, transportation or the like of the slit band plates.

To prevent the slit band plates from being loosely wound up on the mandrel, the convectional art employs a by-roller tension applying apparatus or a tension pad apparatus, which applies tension to the slit band plates. However, those tension applying apparatuses also suffer from other problems. In the former, the slit band plates are nonuniformly tensed by the thickness difference, and in the latter, the surfaces of the slit band plates are scarred.

In U.S. Pat. No. 3,735,937, a tension applying apparatus which makes no scar on the surfaces of the slit band plates and can correct the unevenness of the wind-up tension caused by the thickness difference of the slit band plates is disclosed. This tension applying apparatus of U.S. Pat. No. 3,735,937, which uses endless belts, is constructed such that upper and lower groups of endless belts stretched between a pair of pulleys are oppositely disposed, each group of the endless belts being arrayed side by side in the transverse direction. Slit band plates is moved through a nip between the outer surfaces of the upper and lower groups of the endless belts. Pressure applying members disposed within the endless belts to vertically push the inner surfaces of the endless belts to press the endless belts against both sides of the slit band plates, the endless belts are cyclicaly turned together with the moving slit band plates. Tension is generated in the slit band plates by a frictional force generated through a slip, which takes place in the relative motion of the inner surfaces of the endless belts to the pressure applying members. And a coefficient of friction of the outer surfaces of the endless belts is higher than that of the inner surfaces la thereof. With such a construction, the slit band plates can be wound up free from a slip of the endless belts, and without scarring the slit band plates.

In the tension applying apparatus described above, the endless belts stretched between a pair of pulleys are circularly turned tracing a path of an elliptical shape, that is, repeatedly turned tracing linear paths between the pulleys and semicircular paths around the pulleys. Accordingly, the endless belts alternately experience a linear deformation when those travel along the linear path between the pulleys and a semicircle deformation when those travel along the semicircle path around the pulley. A bending resistance of the circularly turning endless belts is large. Particularly in the case of thin plates of low tension, the pressure of the belts against the band plates is small, so that a frictional force acting on the belts and the band plates is smaller than the bending resistance of the belts. This hinders a smooth circulation of the endless belts between the pulleys, and results in making a scar on the surfaces of the band plates. At this time, the surfaces of the endless belts are also scarred. Accordingly, the endless belts must be replaced by new ones frequently.

Since the linear deformation and the semicircular deformation are alternately repeated in the cyclicaliy turning endless belts, the material for the endless belts must be flexible, that is, easily worn. Accordingly, the endless belts made of such material must be replaced with new ones at relatively short intervals. The work of replacing a number of endless belts is troublesome and time consuming. During the replacing work, the wind-up work of the slit band plates is prohibited, resulting in poor efficiency of the wind-up work.

The present invention has been made in view of the above circumstances and has a first object to provide a circular type tension applying apparatus for slit band plates, the apparatus in which the endless belts are circularly turned tracing a path substantially of a circle, and no bending resistance is created in the circularly turning endless belts, thereby ensuring a smooth circulation of the endless belts, making no scar on the surfaces of the slit band plates, allowing use of the endless belts made of relatively hard material of less wear, and elongating the lifetime of the endless belts. A second object of the present invention is to a circular type tension applying apparatus for metal band plates, the apparatus which uses the endless belts having sufficient compressibility and restoration force in the thickness direction, thereby generating an additional tension in the slit band plates by a resistance force, which ensues from a deformation by compressive strain when those are sufficiently compressed in the thickness direction.

SUMMARY OF THE INVENTION

To achieve the first object, the invention provides a circular type tension applying apparatus for slit band plates comprising a plurality of pairs of upper and lower endless belts for interposing the respective slit band plate, an upper pressure applying member for allowing the upper endless belts to rotate and for applying pressure to the upper endless belts, and a lower pressure applying member for allowing the lower endless belts to rotate and for applying pressure to the lower endless belts. Each of the endless belt independently and circularly rotates, and an outer surface of the endless belts being larger in friction than an inner surface of the endless belts. Both of the upper and lower pressure applying members are substantially circular in section.

To achieve the second object, the invention provides a cicular type tension applying apparatus for slit band plates described above, wherein the endless belts have sufficient compressibility and stability in thickness direction so that tension is generated in the slit band plates by a frictional force generated through a slip, which takes place in the relative motion of the inner surface of the endless belts to the upper and lower pressure applying means, and a resistance force, which ensues from a deformation by compressive strain when said endless belts are sufficiently compressed in the thickness direction.

The thus constructed invention operates as follows.

After the slit band plates is moved through a nip between the outer surfaces of the upper and lower groups of the substantially circular endless belts, upper and lower pressure applying members, which respectively support the upper and lower groups of the endless belts each being substantially circular so as to allow the endless belts to circularly turn, while keeping them substantially circular in shape and pushing outward the inner surfaces of the endless belts, push at equal pressure the inner surfaces of the endless belts which are in contact with the pressure applying members, and the pressure applying members uniformly press the slit band plates which are brought into contact with the endless belts being in contact with the pressure applying members.

The curvatures at the respective points on the substantially circular endless belts are substantially equal. No bending resistance arises in the endless belts 1 that is circularly turning tracing a substantially circle. The endless belts are driven to move by frictional engagement of the endless belts per se with the moving slit band plates, without any slip. In this case, the endless belts are independently and circularly turned together with the moving slit band plates while tracing a path of a substantially circle. Tension is uniformly applied to the slit band plates without making scars on the surfaces of the slit band plates by a frictional force generated through a slip, which takes place in the relative motion of the inner surfaces of the endless belts to the pressure applying members.

In the invention, since the endless belts have sufficient compressibility and restoration force in the thickness direction, the endless belts generate an additional tension in the slit band plates by a resistance force, which ensues from a deformation by compressive strain when those are sufficiently compressed in the thickness direction. This tension acts on the slit band plates, in addition to the tension caused by the friction.

DETAILED DESCRIPTION OF THE PREFERRED EMBODIMENTS

The present invention will be described in more detail using the preferred embodiments of the invention in connection with the accompanying drawings.

Figure 1:
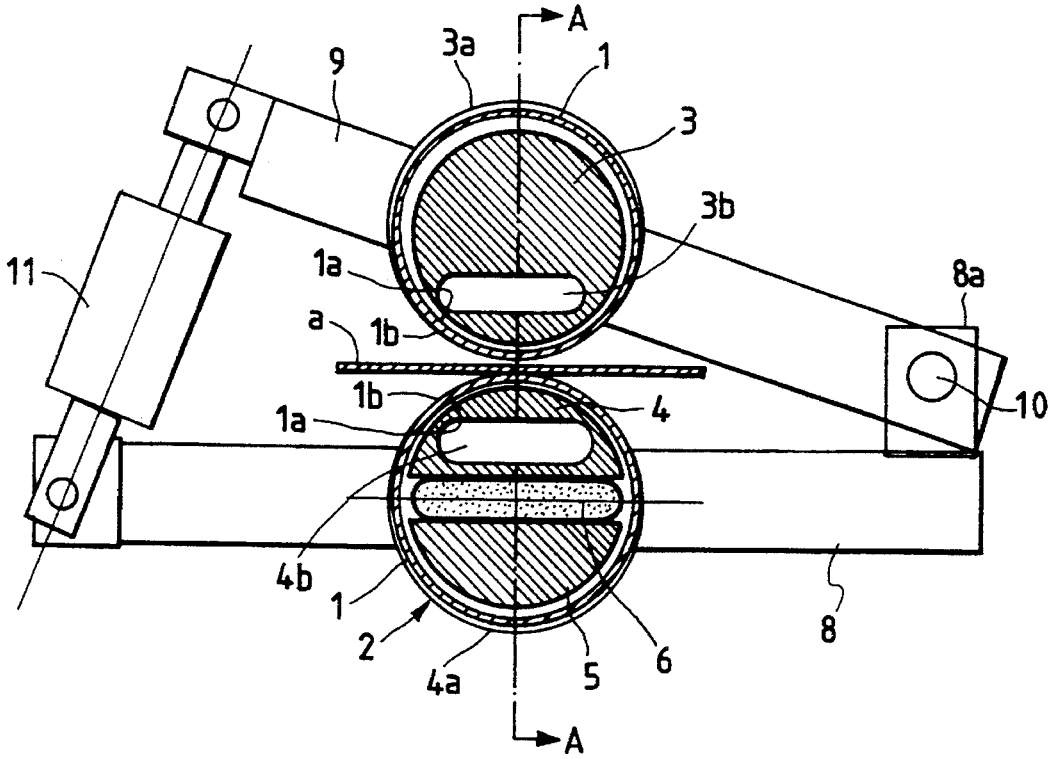
FIG. 1 shows a schematic sectional side view of a key portion of an embodiment of the present invention.
Figure 2:
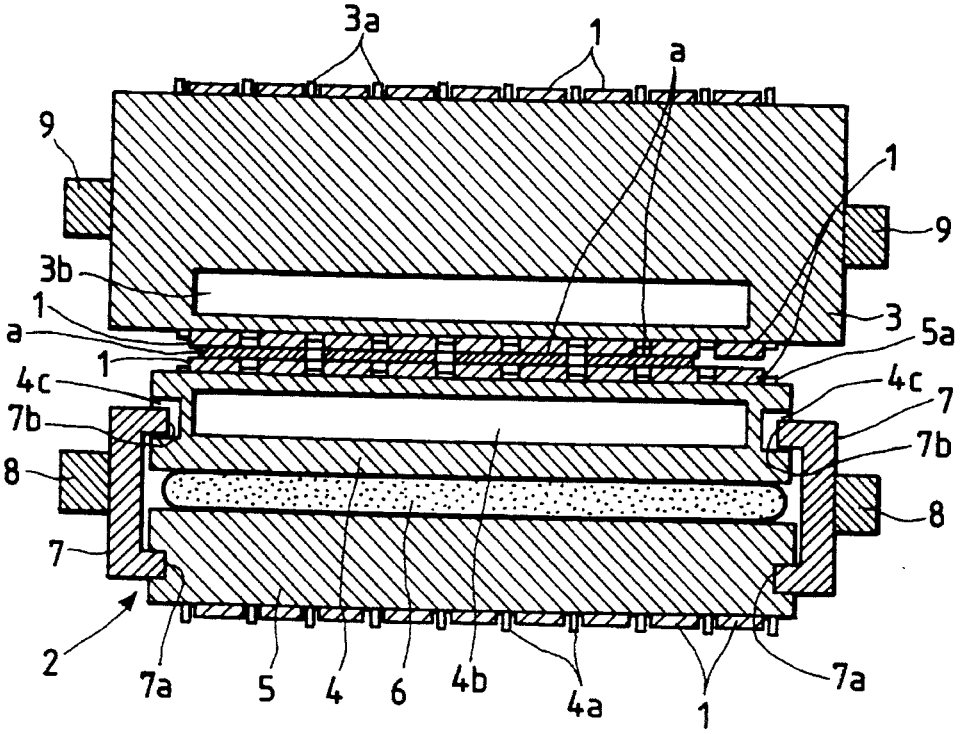
FIG. 2 shows a cross sectional view taken on line A—A of FIG. 1.

FIG. 1 is a schematic sectional side view of a key portion of an embodiment of the present invention, and FIG. 2 is a cross sectional view taken on line A—A of FIG. 1.

In the figures, a circular type tension applying apparatus operates to stretch slit band plates a at a given tension. The circular type tension applying apparatus is located in the front of a band plate take-up device (not shown) on the path along which the slit band plates a move. The circular type tension applying apparatus comprises upper and lower groups of endless belts 1, substantially circular in cross section, which circularly turn tracing a path of a substantially circle, and upper and lower pressure applying members 3 and 2 which respectively support the upper and lower groups of the endless belts 1 so as to allow the endless belts to circularly turn, while keeping them substantially circular in shape and pushing outward inner surfaces 1*a* of the endless belts 1. The lower pressure applying member 2 pushes upward the endless belts 1 located on the lower side, whereas the upper pressure applying member 3 pushes downward the endless belts 1 located on the upper side.

The endless belts 1 are arranged in the moving direction of the slit band plates a in a state that the endless belts may be circularly turned. These endless belts 1 are arrayed side by side in the transverse direction, viz., in the direction orthogonal to the moving direction of the slit band plates a. These endless belts 1 are arranged in two groups, the upper group and the lower group located below the upper group.

Each of the upper and lower groups of the endless belts 1, disposed one above the other, are endless belts each shaped to be substantially circular in cross section. The upper and lower groups of the endless belts 1 are respectively put on the circumferential outer surfaces of the pressure applying member 3 which is circular in cross section and located on the upper side, and paired semicircular pressing members 4 and 5, disposed one above the other. The semicircular pressing members 4 and 5, when combined, form a structure circular in cross section, which serves as the lower pressure applying member 2 located on the lower side. Those groups of the endless belts 1 thus arranged may be independently turned along the outer surfaces of those pressure applying members in a circulative fashion. The endless belts 1 are mounted so as to circularly turn in the moving direction of the slit band plates a.

The pressure applying members 2 and 3 with the endless belts 1 put thereon are not provided with drive sources for circularly turning the endless belts 1. The endless belts 1 are moved by frictional engagement of them with the moving slit band plates a. In other words, the endless belts cannot turn by their own ability. Thus, the endless belts 1 will not circularly turn unless they come in contact with the slit band plates a.

Outer surfaces 1*b* of the substantially circular endless belts 1 cooperate with the slit band plates a to move the slit band plates a for circulation. The inner surfaces 1*a* of the endless belts 1 function to tense the slit band plates a by a friction force generated when the belts slip on the pressure applying members 2 and 3.

With such different functions, the outer surfaces 1*b* of the substantially circular endless belts 1 are made of such a material that has a higher coefficient of friction than that of the inner surfaces 1*a* thereof. Accordingly, the inner surface of the endless belts 1 may be made of wear proof material, for example, synthetic resin having low coefficient of friction. The outer surface of the endless belt may be made of elastic material having compressibility and restoration force, and high coefficient of friction. Specific examples of this type of the material are rubber or synthetic resin. Softness is not required for the material of the endless belts 1 unlike the conventional endless belts. Accordingly, a relatively hard material of low wear, such as a thin metal plate, may be used for the back surface material of the endless belts 1. Alternatively, the coefficient of friction of the inner surfaces 1*a* of the endless belts 1 may be reduced to below that of the outer surface 1*b* thereof in a manner that the inner surfaces 1*a* of the endless belts 1 and the slip surfaces of the pressure applying members 2 and 3 are coated with lubricant.

The pressure applying member 2 is disposed in a state that it is inserted into a number of endless belts 1 disposed on the lower side. The pressure applying member 2 thus disposed includes a pair of upper and lower semicircular pressing members 4 and 5, and an expandable bag 6. The semicircular pressing members 4 and 5 directly press the inner surfaces 1*a* of the endless belts 1. The expandable bag 6, interposed between the upper and lower semicircular pressing members 4 and 5, presses the semicircular pressing members 4 and 5 against the inner surfaces 1*a* of the endless belts 1.

The upper and lower pressing members 4 and 5 each take a semi-cylindrical shape and are given a predetermined length and height. The semi-cylindrical pressing members are combined into a structure being circular in cross section as the pressure applying member 2. In combining them, the flat surfaces of the semi-cylindrical pressing memberd face each other. The structure is disposed in a state that the longitudinal direction thereof is orthogonal to the moving direction of the slit band plates a and the structure passes through the endless belts 1.

The surfaces of the semicircular pressing members 4 and 5, which are to be in contact with the inner surfaces 1*a* of the endless belts 1, are shaped to be arcuate, while the surfaces thereof, which interpose the expandable bag 6, are shaped to be flat. The semicircular pressing members 4 and 5 having the thus shaped surfaces uniformly press the inner surfaces 1*a* of the endless belts 1, which are arrayed side by side in the transverse direction. Further, the surfaces of the semicircular pressing members 4 and 5 are made so as to exhibit low friction against the inner surfaces 1*a* of the endless belts 1.

A plural number of belt guide protrusions 4*a* and 5*a* are circumferentially provided at given intervals on the semicircular outer surfaces of the semicircular pressing members 4 and 5. The belt guide protrusions 4*a* and 5*a* function to separate the endless belts 1 arrayed side by side in the transverse direction. A cooling water chamber 4*b* is formed in the semicircular pressing member 4 located closer to the slit band plates a, while being extended in the direction crossing the endless belts 1.

The expandable bag 6 is held in a state that it is vertically interposed between the pair of the upper and lower semicircular pressing members 4 and 5. The expandable bag 6 is an empty bag defined by given values of width, length and height. The expandable bag 6 is disposed such that the longitudinal direction thereof is orthogonal to the moving direction of the slit band plates a, and the bag passes through the endless belts 1 transversely arrayed side by side. The expandable bag 6 is filled with fluid of gas or liquid. The expandable bag is made of material having sealing properties high enough to prevent fluid from leaking from the inside of the expandable bag. This type of material is a material that is well expandable and shrinkable, for example, synthetic resin.

The expandable bag 6, when expanded by pressure of the fluid contained therein, presses uniformly the flat surfaces of the semicircular pressing members 4 and 5 disposed one above the other by the fluid pressure. The expandable bag 6 can uniformly press the slit band plates a through the semicircular pressing member 4. When a fluid pressure within the expandable bag 6 is changed, a pressure against the semicircular pressing member 4 changes. Accordingly, the pressure of the expandable bag 6 against the slit band plates a through the semicircular pressing member 4 may be controlled by changing the fluid pressure within the expandable bag 6. The fluid may be such gas or liquid as air or oil.

Stoppers 7, shaped like U in cross section, are mounted on both ends of the semicircular pressing members 4 and 5. The stoppers 7 hold the pair of upper and lower semicircular pressing members 4 and 5, which vertically interpose the expandable bag 6, in a substantially circular form when viewed in cross section. The protruded parts 7*a* of the stoppers 7 are respectively inserted into the holes formed in both ends of the semicircular pressing member 5 while the protruded parts 7*b* thereof are respectively inserted into the holes 4*c* formed in both ends of the semicircular pressing member 4. The hole 4*c* is slightly larger than the protruded part 7*b* of the stopper 7.

The pressure applying member 3 is shaped substantially like a circle in cross section, and disposed passing through the endless belts 1 located on the upper side, when viewed in cross section. The upper pressure applying member 3 cooperates with the lower pressure applying member 2 to oppositely press, at equal pressures, the slit band plates a moving through a nip between the upper and lower groups of the endless belts oppositely disposed, thereby stretching the slit band plates a at a given tension.

The lower surface of the pressure applying member 3, which is in contact with the inner surfaces 1*a* of the endless belts 1 are finished so as to be parallel to the upper surface of the semicircular pressing member 4 constituting the lower pressure applying member 2. The pressure applying members having such surfaces can uniformly press the inner surfaces 1*a* of the endless belts 1 disposed side by side in the transverse direction. The lower surface of the pressure applying member 3 is finished so as to exhibit low friction against the inner surfaces 1*a* of the endless belts 1.

The endless belts 1, disposed side by side in the transverse direction, independently turn around the circumferential outer surface of the pressure applying member 3 of which the cross section is substantially circular. The surface of the pressure applying member 3 is shaped to be arcuate so as to allow the endless belts 1 to smoothly turn therearound in a circular form.

A plural number of belt guide protrusions 3*a* are circumferentially provided at given intervals on the circular outer surfaces of the pressure applying member 3. The belt guide protrusions 3*a* function to separate the endless belts 1 arrayed side by side in the transverse direction. A cooling water chamber 3*b* is formed in the lower portion of the innards of the pressure applying member 3, while being extended in the direction crossing the endless belts 1.

The stoppers 7, which are provided at both ends of the paired upper and lower semicircular pressing members 4 and 5 of the pressure applying member 2, are fastened to horizontal support arms 8, which are horizontally provided on both sides of the pressure applying member 2. The pressure applying member 2 is supported by the main body of the circular type tension applying apparatus through the horizontal support arms 8.

The pressure applying member 3 is fastened at both ends to elevation support arms 9 obliquely arranged. The lower end of the each elevation support arm 9 is rotatably supported by a shaft 10 that is received by a bearing 8*a* located above the first end of the each horizontal support arm 8. The upper end of a cylinder 11 is coupled with the upper end of the elevation support arm 9 by means of a pin, while the lower end thereof is coupled with the second end of the horizontal support arms 8 by means of a pin.

The elevation support arms 9, the shaft 10, and the cylinder 11 make up a mechanism for vertically moving the pressure applying member 3 with respect to the pressure applying member 2. When a piston of the cylinder 11 is extended upward, the each elevation support arm 9 is turned upward about the shaft 10 to elevate for opening the pressure applying member 3, which is fastened to the each elevation support arm 9. When the extended piston of the cylinder 11 is drawn back, the elevation support arms 9 are turned downward about the shaft 10 to move downward for closing the pressure applying member 3, which is fastened to the each elevation support arm 9.

The operation of tile thus constructed circular type tension applying apparatus according to the first embodiment of the present invention will be described.

The piston of the cylinder 11 is extended to turn upward the elevation support arms 9 and to elevate for opening the pressure applying member 3. The slit band plates a are fed into the nip between the outer surfaces 1*b* of the upper and lower groups of the endless belts 1 oppositely disposed. The piston of the cylinder 11 is retracted to turn downward for closing the pressure applying member 3. After the feeding process of the slit band plates a is completed, fluid is put into the expandable bag 6 interposed between the upper and lower semicircular pressing members 4 and 5, thereby expanding the bag. The fluid is forcibly put into the expandable bag 6 by using a pump (not shown), for example.

The expandable bag 6, when expanded, presses the semicircular pressing members 4 and 5, which are in contact with the expandable bag 6. Since as well known, pressure is equal at every point in the fluid, the expandable bag 6 presses at equal pressure the semicircular pressing members 4 and 5 over the entire surface areas thereof where these pressing members are in contact with the expandable bag 6. As the result of the vertical expansion of the expandable bag 6, the upper surface of the semicircular pressing member 4 is brought into close contact with the inner surfaces 1*a* of the endless belts 1. Together with the semicircular pressing member 4 pushed upward by the fluid pressure of the expandable bag 6, the endless belts 1 are moved upward, so that the outer surfaces 1*b* of the endless belts 1 that are in close contact with the semicircular pressing member 4, are brought into close contact with the back surfaces of the slit band plates a.

After the outer surfaces 1*b* of the endless belts 1 are brought into close contact with the back surfaces of the slit band plates a, the slit band plates a are pushed upward to bring the outer surfaces 1*b* of the upper group of the endless belts 1 into close contact with the surfaces of the slit band plates a, thereby arising a reaction force therein. As a result, the outer surfaces 1*b* of the upper and lower groups of the endless belts 1 oppositely press the obverse and reverse sides of the slit band plates a at equal pressure. With the nature that pressure is equal at every point in the fluid contained in the expandable bag 6, pressure is uniformly applied to the entire areas of both sides of the slit band plates a, which are in close contact with the outer surfaces 1*b* of the upper and lower groups of the endless belts 1.

When the operation of taking up the slit band plates a starts, the frictional engagement of both sides of the moving slit band plates a with the outer surfaces 1*b* of the endless belts 1 causes the upper and lower groups of the endless belts 1 to circularly turn tracing a path substantially of a circle. At this time, those groups of the endless belts 1 circularly turn tracing substantially a circle. Therefore, the curvatures at the respective points on the circularly turning endless belts are substantially equal. And no bending resistance is created in the endless belts 1 that are circularly turning tracing substantially a circle. For this reason, the endless belts 1 independently turn together with the moving slit band plates a without any slip.

By a frictional force generated through a slip, which takes place in the relative motion of the inner surfaces 1*a* of the endless belts 1 to the upper pressure applying member 3 and the semicircular pressing members 4 and 5 forming the lower pressure applying member 2, in other words, since the pressure applying member 3 and the semicircular pressing members 4 and 5, which press the inner surfaces 1*a* of the endless belts 1 which are circularly turning while tracing a path of a substantially circle, serve as a kind of brake, tension is generated in the slit band plates a, which are extended between the band plates take-up apparatus and the circular type tension applying apparatus. The generated tension can be controlled as desired by controlling the pressure of the fluid in the expandable bag 6.

Figure 3A:
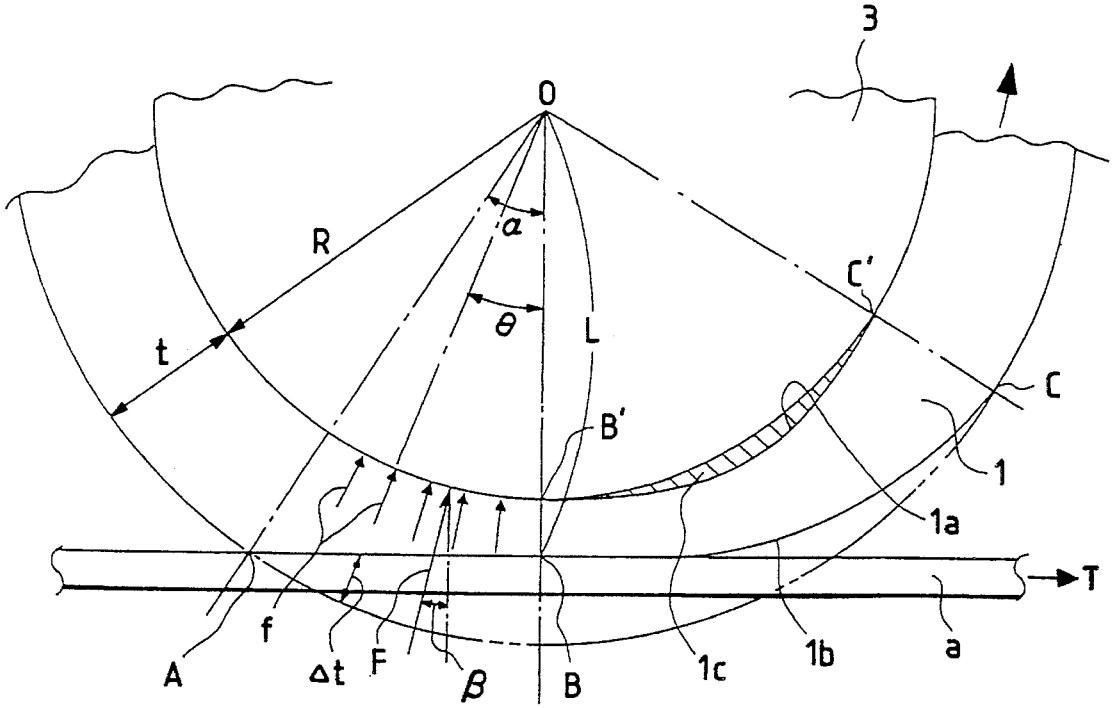
FIGS. 3A to 3C show explanatory diagrams showing the principle of the second embodiment of the present invention.
Figure 3B:
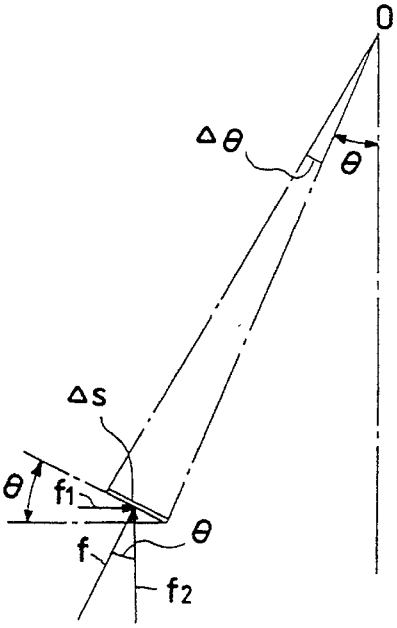
Figure 3C:
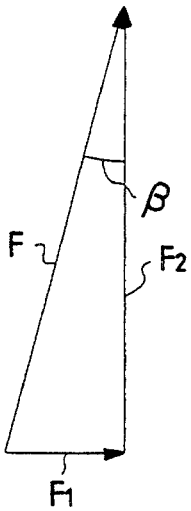

FIGS. 3A to 3C are diagrams useful in explaining the principles of a second embodiment of a circular type tension applying apparatus according to the present invention.

The second embodiment is different from the first embodiment in the construction of the endless belts 1. The remaining portions are equal to those of the first embodiment, and hence description of them will be omitted.

The endless belts 1 of the second embodiment have sufficient compressibility and stability in the thickness direction. The endless belts 1 generate an additional tension in the slit band plates a by a resistance force, which ensues from a deformation by compressive strain when those are sufficiently compressed in the thickness direction. This tension additively acts on the slit band plates a.

In the case of the endless belts 1 of the first embodiment, tension T1 caused in the slit band plates a by the friction, which is generated in the relative motions of the inner surfaces 1*a* of the upper and lower groups of the endless belts 1 to the pressure applying member 3 and the semicircular pressing members 4 and 5, is expressed by $$T1=2\ (\mu \cdot W)$$

(numeral 2 is used since tension acts on both sides of the slit band plates a)

where μ: coefficient of friction of the inner surfaces 1*a* of the endless belts 1

W: vertical load by the pressure applying member 3.

Since the endless belts 1 of the second embodiment have sufficient compressibility and stability in the thickness direction, the endless belts 1 generate an additional tension in the slit band plates a by a resistance force, which ensues from a deformation by compressive strain when those are sufficiently compressed in the thickness direction. This tension acts on the slit band plates a, in addition to the tension caused by the friction.

The endless belts 1 of the second embodiment are sufficiently compressed to be deformed in the thickness direction, as shown in FIG. 3A, when those are brought into close contact with the surfaces of the slit band plates a. In the figure, a point A indicates a start point of the compression of each of the endless belts 1; a point B, an end point of the compression of the endless belt 1; and a point C, an end point of restoration of the deformed endless belt 1. The compression end point B coincides with the restoration end point C of the endless belt 1. The endless belt 1, which is turning at high speed in a state that these are in contact with the slit band plates a, will advance, by their inertia, in the same direction as the advancing direction of the slit band plate a. For this reason, in a range from a point B' to a point C', a gap (illustrated shaded) 1*c* is created between the inner surface 1*a* of the endless belt 1 and the pressure applying member 3.

A quantity of compression of the endless belt 1, the thickness of which is sufficiently compressed in the range from the start point A to the compression end point B, is gradually large toward the compression end point B. Responsive to the compression, a reaction force f acts in the compressed and deformed endless belt 1. The reaction force f is directed to the center of the endless belt 1 because the endless belt 1 is substantially circular in shape.

In this case, at the end point B the reaction force f is vertical in direction to the endless belt 1, and has no horizontal component. In the range from the point B to the start point A, the reaction force f is gradually slanted to the endless belt 1. Therefore, in this range the reaction force f contains a horizontal component f1 parallel to the endless belt 1. The sum of all f1s of the reaction force generates another tension T2 in the slit band plate a. This tension T2

$$T2=2\ (W\cdot\tan\beta)\ ,$$

where W: vertical load by the pressure applying member 3

β: inclination of the total reaction force F with respect to a plane vertical to the endless belt 1.

The expression of tension T2, T2=2(W·tanβ), can be obtained in the following way.

In FIG. 3A, the center of the circle of the endless belt 1 is denoted as O. Let us consider a balance of forces at an angle θ at which the reaction force is slanted from a line OB toward a line OA.

Assuming that a distortion of the endless belt 1 in the thickness direction at the angle θ is Δt, the reaction force f at the angle θ is $$f=(E\cdot\Delta t)/t$$

where E : modulus of elasticity of the endless belt 1 in the thickness direction t : thickness of the endless belt 1

The distortion Δt is expressed by $$\Delta t=(R+t)-(L/\cos\theta),$$

where R: radius of the inner circumference of the endless belt 1

L : length from the point B to the center O.

Assuming that an arcuate infinitesimal area at a point on which the reaction force L acts at the angle θ is denoted as Δs, an inclination of the infinitesimal are Δs at that point is θ. The horizontal component f1 of the reaction force is $$f1=(f\cdot\Delta s)\cdot\sin\theta,$$

where Δs=R·Δθ (Δθ: infinitesimal angle at the angle θ, see FIG. 3B).

The horizontal component F1 of the total reaction force F in the range from the point A and the point B where the endless belt 1 is in close contact with the slit band plate a is $$F1=\Sigma f.$$

This horizontal component F1 (=Σ f1) is the tension T2 generated anew in the slit band plate a. The tension T2 is $$T2=2F1=2\ \Sigma f1$$

(numeral 2 is used since tension acts on both sides of the slit band plate a).

The vertical component f2 at the angle θ is $$f2=(f\cdot\Delta s)\cdot\cos\theta.$$

The vertical component F2 of the total reaction force F in the range from the point A and the point B where the endless belt 1 is in close contact with the slit band plate a is $$F2=\Sigma f.$$

The vertical component F2 of the total reaction force F is equal to a vertical load W.

Accordingly, $$F2=\Sigma f2=W.$$

For the inclination β of the total reaction force F with respect to a plane vertical to the endless belt 1, the following equation holds $$\tan\beta=(F1/F2).$$

(see FIG. 3C)

Rearranging the equation, we have $$F1=F2\cdot\tan\beta=W\cdot\tan\beta.$$

Therefore, the tension T2 generated anew in the slit band plate a is expressed by $$T2=2F1=2\ (W\cdot\tan\beta)\ .$$

In the second embodiment, the total tension T generated in the slit band plate a is $$T=T1+T2=2(\mu\cdot W)+2(W\cdot\tan\beta).$$

A value of the tanβ can be obtained in the following manner.

The horizontal component f1 of the reaction force and the vertical component f2 thereof at the angle θ in the range from the point A to the point B are integrated in the range from 0 to α, as in the following.

$$F1=\Sigma f1=\{(R+1)(1-\cos\alpha)+L\cdot\log(\cos\alpha)\}\cdot(E\cdot R)/t$$

$$F2=\Sigma f2=\{(R+1)\cdot\sin\alpha-L\cdot\alpha\}\cdot(E\cdot R)/t$$

where α: angle between a line OA connecting the center O to the start point A at which the compression of the endless belt 1 starts in a state that it is in close contact with the slit band plate a, and a line OB connecting the compression end point B to the center O (FIG. 3A). Using the above equations, tanβ can be expressed by $$\begin{aligned}\tan\beta &= (F1/F2)\\ &= \{(R+1)(1-\cos\alpha)+L\cdot\log(\cos\alpha)\}/\\ &\quad \{(R+1)\cdot\sin\alpha-L\cdot\alpha\}\end{aligned}$$

While the present invention has been described using the specific embodiments, it should be understood that the invention may variously be changed, modified and altered within the scope and spirits of the invention. In the embodiments as mentioned above, the inner surfaces 1*a* of the upper group of the endless belts 1 are pressed by the pressure applying member 3 substantially circular in cross section. If required, the upper pressure applying member 3 may be replaced with the lower pressure applying member 2 consisting of the paired semicircular pressing members 4 and 5.

In the embodiments as mentioned above, the inner surfaces 1*a* of the lower group of the endless belts 1 are pressed by the pressure applying member 2 consisting of the paired semicircular pressing members 4 and 5. If required, the pressure applying member 2 may be replaced by the pressure applying member 3.

In the construction of the circular type tension applying apparatus, the pressure applying member 2 located on the lower side may be interchanged with the pressure applying member 3 located on the upper side. That is, the pressure applying member 2 is located on the upper side, and the pressure applying member 3 is located on the lower side.

In the above-mentioned embodiments, the expandable bag 6 is inserted between the semicircular pressing members 4 and 5, which form the pressure applying members 2. If required, the expandable bag 6 may be substituted by screw means which can adjust the distance between the semicircular pressing members 4 and 5.

Figure 4:
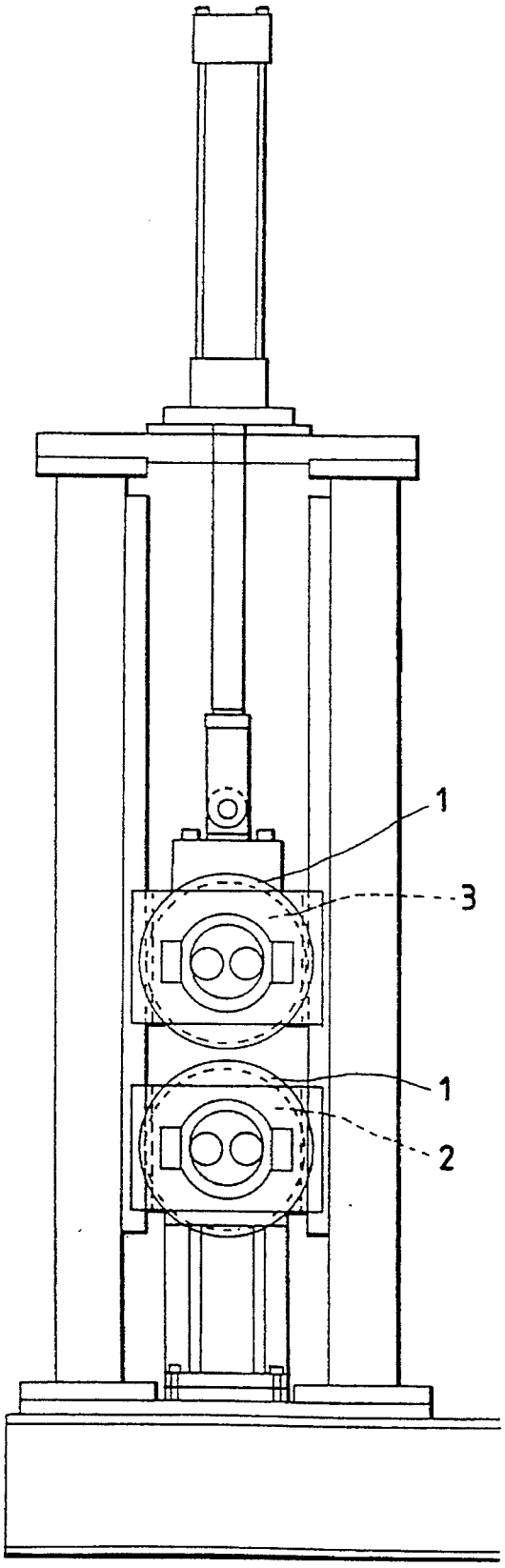
FIG. 4 shows a schematic sectional side view showing an overall construction of another embodiment of the present invention.

In the above-mentioned embodiments, the elevation support arm 9 is used for opening and closing the pressure applying member 3. Alternatively, a translation cylinder which operates in a rectilinear motion may be used, as shown in FIG. 4.

As seen from the foregoing description, in the circular type tension applying apparatus of the invention, the endless belts circularly turn in while tracing a path substantially of a circle. The curvatures of the endless belts are substantially equal at the respective points thereon, so that no bending resistance is created in the endless belts 1 that are circularly turning, ensuring a smooth turn of the endless belts. Accordingly, the circular type tension applying apparatus can handle any type of thin band plates. The unwanted situation that the endless belts are unsmoothly turned to make a scar on the surfaces of the slit band plates, is solved. Another unwanted situation that the surfaces of the endless belts are scarred, and the endless belts must be replaced with new ones frequently, is also prevented.

Further, substantially circular endless belts can be used in the circular type tension applying apparatus of the present invention. Because of this, use of flexible material is not required for making the endless belts, although use of such a material is required in the conventional tension applying apparatus. In the invention, the belts made of relatively hard material of less wear can be used, so that the lifetime of the endless belts is elongated. The period of time required for replacing of the endless belts with new ones is elongated. Accordingly, there is eliminated reduction of the working efficiency in winding up the slit band plates which results from the frequent replacing of the endless belts. Additionally, there is no need of using a number of pairs of pulleys, which are respectively used for a number of endless belts. This fact leads to a remarkable reduction of cost to manufacture.

In the circular type tension applying apparatus according to the invention, since the endless belts have sufficient compressibility and restoration force in the thickness direction, the endless belts generate an additional tension in the slit band plates by a resistance force, which ensues from a deformation by compressive strain when those are sufficiently compressed in the thickness direction. This tension acts on the slit band plates, in addition to the tension caused by the friction. The thus constructed circular type tension applying apparatus can generate a desired tension by a small pressure corresponding to compression distortion resistance when comparing with the circular type apparatus constructed so as to generate a desired tension using only friction resistance. Accordingly, the inner surfaces of the endless belts is less worn, elongating the lifetime thereof.

What is claimed is:

1. A circular type tension applying apparatus for slit band plates, said apparatus comprising:

a plurality of pairs of upper and lower endless belts for interposing the respective slit band plates, each of said endless belts independently and circularly rotating;

an upper pressure applying means for allowing said upper endless belts to rotate around said upper pressure applying means and for applying pressure to said upper endless belts, said upper pressure applying means being substantially circular in section; and a lower pressure applying means for allowing said lower endless belts to rotate around said lower pressure applying means and for applying pressure to said lower endless belts, said lower pressure applying means being substantially circular in section.

2. An apparatus according to claim 1, wherein an outer surface of said endless belts is larger in friction than an inner surface of said endless belts so that tension is generated in the slit band plates by a frictional force, the frictional force through a slip taking place in the relative motion of said inner surface of said endless belts to said upper and lower pressure applying means.

3. An apparatus according to claim 2, wherein said inner surface of said endless belts is made from metal, and said outer surface of said endless belts is made from rubber.

4. An apparatus according to claim 1, wherein lubricating material is provided between said inner surface of said endless belts and each outer surface of said upper and lower pressure applying means.

5. An apparatus according to claim 1, wherein said endless belts have sufficient compressibility and restoration force in thickness direction so that tension is generated in the slit band plates by a frictional force and a resistance force, the frictional force through a slip taking place in the relative motion of said inner surface of said endless belts to said upper and lower pressure applying means, the resistance force ensuing from a deformation by compressive strain of said endless belts in the thickness direction.

6. An apparatus according to claim 1, wherein said upper pressure applying means comprises:

an upper semicircular member;

a lower semicircular member; and pressure control means for controlling amount of pressure to said endless belts, said pressure control means interposed between said upper and lower semicircular members.

7. An apparatus according to claim 6, wherein said upper pressure applying means further comprises engage means for engaging said upper and lower semicircular members, said engage means having first and second protrusions, said upper semicircular member has a first engage recess on each side surface thereof for receiving said first protrusion, said lower semicircular member has a second engage recess on each side surface thereof for receiving said second protrusion, and said second engage recess of said lower semicircular member is larger than said second engage protrusion of said engage means to allow for said lower semicircular member to slidably move toward the slit band plates.

8. An apparatus according to claim 1, wherein said lower pressure applying means comprises:

an upper semicircular member;

a lower semicircular member; and pressure control means for controlling amount of pressure to said endless belts, said pressure control means interposed between said upper and lower semicircular members.

9. An apparatus according to claim 8, wherein said lower pressure applying means further comprises engage means for engaging said upper and lower semicircular members, said engage means having first and second protrusions, said upper semicircular member has a first engage recess on each side surface thereof for receiving said first protrusion, said lower semicircular member has a second engage recess on each side surface thereof for receiving said second protrusion, and said first engage recess of said upper semicircular member is larger than said first engage protrusion of said engage means to allow for said upper semicircular member to slidably move toward the slit band plates.

* * * * *